US011608550B2

(12) United States Patent
Zhou et al.

(10) Patent No.: US 11,608,550 B2
(45) Date of Patent: Mar. 21, 2023

(54) HOT WORKING DIE STEEL WITH HIGH THERMAL STRENGTH AND HIGH TOUGHNESS AND MANUFACTURING PROCESS THEREOF

(71) Applicant: Rugao Hongmao Heavy-duty Forging Co., Ltd., Jiangsu (CN)

(72) Inventors: Qingchun Zhou, Jiangsu (CN); Weiming Xu, Jiangsu (CN); Jincai Gu, Jiangsu (CN); Jianhui Ge, Jiangsu (CN); Bowei Zhao, Jiangsu (CN); Junliang Wu, Jiangsu (CN); Sheng Ma, Jiangsu (CN)

(73) Assignee: Rugao Hongmao Heavy-duty Forging Co., Ltd., Nantong (CN)

( * ) Notice: Subject to any disclaimer, the term of this patent is extended or adjusted under 35 U.S.C. 154(b) by 0 days.

(21) Appl. No.: 17/460,308

(22) Filed: Aug. 30, 2021

(65) Prior Publication Data

US 2022/0372601 A1 Nov. 24, 2022

(30) Foreign Application Priority Data

May 24, 2021 (CN) ..... 202110567813.9

(51) Int. Cl.

| | |
|---|---|
| ***C22C 38/30*** | (2006.01) |
| ***C22C 38/22*** | (2006.01) |
| ***C22C 38/26*** | (2006.01) |
| ***C22C 38/28*** | (2006.01) |
| ***C22C 38/02*** | (2006.01) |
| ***C22C 38/04*** | (2006.01) |
| ***C22C 38/00*** | (2006.01) |
| ***C21D 9/00*** | (2006.01) |
| ***C21D 8/00*** | (2006.01) |

(52) U.S. Cl.

CPC ..... *C22C 38/30* (2013.01); *C21D 8/005* (2013.01); *C21D 9/0068* (2013.01); *C22C 38/002* (2013.01); *C22C 38/005* (2013.01); *C22C 38/02* (2013.01); *C22C 38/04* (2013.01); *C22C 38/22* (2013.01); *C22C 38/26* (2013.01); *C22C 38/28* (2013.01)

(58) Field of Classification Search

None

See application file for complete search history.

(56) References Cited

FOREIGN PATENT DOCUMENTS

| | | | |
|---|---|---|---|
| CN | 101302599 A | | 11/2008 |
| CN | 104532154 A | | 4/2015 |
| CN | 111549298 A | | 8/2020 |
| JP | 2008248385 A | * | 10/2008 |

* cited by examiner

*Primary Examiner* — Anthony M Liang

(57) ABSTRACT

The present application relates to the technical field of die steel, and particularly discloses a hot working die steel with high thermal strength and high toughness and a manufacturing process thereof. The hot working die steel with high thermal strength and high toughness includes the following components in percentage by mass: 0.20-0.40% of carbon, 0.05-0.20% of silicon, 0.30-0.60% of manganese, 1.00-4.00% of chromium, 0.50-1.50% of molybdenum, 0.20-0.60% of vanadium, 0.60-1.00% of cobalt, 0.06-0.16% of titanium, 0.03-0.08% of yttrium, 0.03-0.08% of niobium, 0.005-0.012% of phosphorus, 0.003-0.008% of sulfur, and a balance of iron and inevitable impurities.

8 Claims, No Drawings

HOT WORKING DIE STEEL WITH HIGH THERMAL STRENGTH AND HIGH TOUGHNESS AND MANUFACTURING PROCESS THEREOF

CROSS-REFERENCE TO RELATED APPLICATION

The present application is based on and claims the priority of Chinese Patent Application No. 202110567813.9, filed on May 24, 2021. The entirety of the above-mentioned patent application is hereby incorporated by reference herein and made a part of this specification.

TECHNICAL FIELD

The present application relates to the technical field of die steel, in particular to a hot working die steel with high thermal strength and high toughness and a manufacturing process thereof.

BACKGROUND ART

Hot working die steel refers to alloy tool steel for dies suitable for hot deformation processing of metals. Generally, the hot working die needs to bear great impact force and pressure when working, the die can also be in direct contact with high-temperature objects, repeated heating and cooling are needed, the use conditions are extremely severe, and therefore the hot working die steel needs to have good comprehensive properties.

The common hot working die steel in the related art is mainly 4Cr5MoSiV1(H13) steel, and is widely used in the market due to good processing property and toughness.

In view of the above-mentioned related art, the following defects exist. When the use temperature of the 4Cr5MoSiV1 (H13) steel exceeds 550° C., carbides in the steel aggregate and grow, so that a steel matrix is softened, the thermal stability of the material is reduced, the high-temperature strength and hardness of the material are reduced, and cracking failure is easy to occur.

SUMMARY

In order to solve the problems that when the service temperature of the steel exceeds 550° C., the high-temperature strength and hardness of the material are reduced, and cracking failure is easy to occur, the present application provides a hot working die steel with high thermal strength and high toughness and a manufacturing process thereof.

In a first aspect, the present application provides a hot working die steel with high thermal strength and high toughness, which adopts the following technical solution.

A hot working die steel with high thermal strength and high toughness includes the following components in percentage by mass: 0.20-0.40% of carbon, 0.05-0.20% of silicon, 0.30-0.60% of manganese, 1.00-4.00% of chromium, 0.50-1.50% of molybdenum, 0.20-0.60% of vanadium, 0.60-1.00% of cobalt, 0.06-0.16% of titanium, 0.03-0.08% of yttrium, 0.03-0.08% of niobium, 0.005-0.012% of phosphorus, 0.003-0.008% of sulfur, and a balance of iron and inevitable impurities.

By adopting the technical solution, the molten metal cobalt in the matrix material can improve the structural stability of the steel in high-temperature operation and maintain the mechanical property of the material at high temperature. Titanium, yttrium and niobium can further improve the thermal stability of the material in a high-temperature environment. In the preparation process of the material, MC-type carbides can be formed by cobalt, titanium, yttrium, niobium and the like, the carbides and the carbides formed by manganese, chromium, molybdenum and vanadium are mutually dissolved to form multiple complex precipitates with a coherent interface relationship with the matrix, the high-temperature stability can be improved, the multiple complex precipitates can strengthen the material in the tempering process, and the secondary hardening phenomenon in the tempering process can be greatly improved. The comprehensive property of the steel is remarkably improved. Meanwhile, the content of each component in the steel is more reasonably adjusted, so that carbides formed in the steel are more reasonably distributed in the steel, and the comprehensive properties such as thermal strength, toughness and the like of the material are improved.

Preferably, the hot working die steel with high thermal strength and high toughness includes the following components in percentage by mass: 0.30-0.40% of carbon, 0.05-0.10% of silicon, 0.20-0.30% of manganese, 2.00-3.00% of chromium, 0.80-1.20% of molybdenum, 0.30-0.50% of vanadium, 0.70-0.90% of cobalt, 0.08-0.12% of titanium, 0.04-0.06% of yttrium, 0.04-0.06% of niobium, and a balance of iron and inevitable impurities.

By adopting the technical solution, the content of each component in the steel is further optimized, and the comprehensive properties such as thermal strength, toughness and the like of the steel can be further improved.

Preferably, the hot working die steel with high thermal strength and high toughness includes the following components in percentage by mass: 0.35% of carbon, 0.08% of silicon, 0.25% of manganese, 2.50% of chromium, 1.00% of molybdenum, 0.40% of vanadium, 0.80% of cobalt, 0.1% of titanium, 0.05% of yttrium, 0.05% of niobium, and a balance of iron and inevitable impurities.

By adopting the technical solution, the content of each component in the steel is further optimized, and the comprehensive properties such as thermal strength, toughness and the like of the steel are further strengthened.

Preferably, a weight ratio of titanium to vanadium is 1:4.

By adopting the technical solution, the thermal stability of the material can be further improved during tempering of the steel.

Preferably, a weight ratio of yttrium to niobium is 1:1.

By adopting the technical solution, the thermal stability of the material in the tempering process can be further improved.

In a second aspect, the present application provides a manufacturing process of hot working die steel with high thermal strength and high toughness, which adopts the following technical solution.

A manufacturing process of the hot working die steel with high thermal strength and high toughness includes the following steps:

material smelting: smelting and refining scrap steel, silicon manganese, ferrosilicon, titanium, vanadium, niobium and rare earth yttrium into a furnace body, performing vacuum degassing, and casting into a steel ingot, in which the scrap steel includes the following components in percentage by mass: 0.25-0.45% of carbon, 0.05-0.18% of silicon, 0.33-0.65% of manganese, 1.6-4.2% of chromium, 0.6-1.8% of molybdenum, 0.7-1.2% of cobalt, sulfur≤0.02%, phosphorus≤0.02%, and a balance of iron;

diffusion annealing: keeping the steel ingot at a high temperature of 1100° C.-1200° C. for 9-15 h;

forging: multidirectional forging the steel ingot after diffusion annealing, to obtain a forging blank;

post-forging heat treatment: cooling the forging blank to 600° C. in a mist cooling mode, air-cooling to 300° C., keeping the air-cooled forging blank at 950° C.-1150° C. for 8-10 h, and air-cooling to room temperature to obtain a heat-treated forging blank;

dehydrogenating and annealing: keeping the heat-treated forging blank at 600° C.-700° C. for 25-30 h, cooling to 150-200° C. at a rate of ≤35° C./h during which the temperature is kept for 3-5 h every time the temperature is reduced by 100° C., discharging from a furnace and cooling to room temperature to obtain a dehydrogenated annealed forging blank; and tempering heat treatment: holding the dehydrogenated annealed forging blank at 550° C.-600° C. for 15-20 h, cooling the forging blank to 200° C. or below, and performing air-cooling to obtain the hot working die steel.

By adopting the technical solution, the raw materials can be well dissolved into the matrix through high-temperature solution, carbides can be precipitated out during tempering treatment, and the precipitated carbides can improve the thermal stability of the steel. Meanwhile, by adjusting the temperature and the heat preservation time in the steps of post-forging heat treatment, dehydrogenating and annealing and tempering heat treatment, the structure of the steel can be improved, and the comprehensive properties such as thermal strength, toughness and the like of the steel can be improved.

Preferably, a heating rate in the steps of post-forging heat treatment, dehydrogenating and annealing, and tempering heat treatment is 8° C.-13° C./min.

By adopting the technical solution, the heating rate in the steps of post-forging heat treatment, dehydrogenating and annealing and tempering heat treatment is adjusted, so that atoms of cobalt, titanium, yttrium, niobium and the like in the steel can be better dissolved into the steel blank, the steel can be further strengthened, and the comprehensive properties such as thermal strength, toughness and the like of the steel are improved.

Preferably, a cooling rate in the steps of post-forging heat treatment, dehydrogenating and annealing, and tempering heat treatment is 15° C.-20° C./h.

By adopting the technical solution, the organization structure of the steel can be stabilized, and meanwhile, carbides can be stably precipitated, so that the thermal strength and toughness of the steel are further improved.

In summary, the application has the following beneficial effects.

1. The metal cobalt is dissolved in the matrix material, so that the structural stability of the steel in high-temperature operation can be improved, and the mechanical property of the material at high temperature can be maintained. Titanium, yttrium and niobium can further improve the thermal stability of the material in a high-temperature environment. In the preparation process of the material, MC-type carbides are formed by cobalt, titanium, yttrium, niobium and the like, the carbides and the carbides formed by manganese, chromium, molybdenum and vanadium are mutually dissolved to form multi-element complex precipitates with a coherent interface relationship with a matrix, the high-temperature property stability can be improved, and the multi-element complex precipitates can strengthen the material in the tempering process. The secondary hardening phenomenon in the tempering process can be greatly improved, so that the comprehensive property of the steel is remarkably improved. Meanwhile, the content of each component in the steel is more reasonably adjusted, so that carbides formed in the steel are more reasonably distributed in the steel, and the comprehensive properties such as thermal strength, toughness and the like of the material are improved.

2. When the content of titanium and vanadium in the steel is 1:4, the thermal stability of the material can be further improved in the material tempering process.

3. According to the method of the present disclosure, the raw materials can be well dissolved into the matrix through high-temperature solution, carbides can be precipitated out during tempering treatment, and the precipitated carbides can improve the thermal stability of steel. Meanwhile, by adjusting the temperature and the heat preservation time in the steps of post-forging heat treatment, dehydrogenating and annealing and tempering heat treatment, the organization of the steel can be improved, and the comprehensive properties such as thermal strength, toughness and the like of the steel can be improved.

DETAILED DESCRIPTION

With the rapid development of industry, more and more die steels are used. As one of the steels, hot working die steels are often used in high-temperature and high-pressure working environment. Therefore, hot working die steels with high thermal strength and high toughness are needed to achieve normal industrial use and prolong the service life of the die. The most commonly used hot working die steel is 4Cr5MoSiV1(H13) steel, however, for many severe high-temperature and high-pressure production environments, 4Cr5MoSiV1(H13) steel also performs poorly. The inventors have found that, by adding cobalt, titanium, yttrium and niobium and adjusting the content of each component in the steel, the high-temperature stability of the steel can be well improved.

EXAMPLES

Examples 1-6

The manufacturing process of the hot working die steel with high thermal strength and high toughness is exemplified by Example 1 below, including the following steps:

Material smelting: smelting and refining scrap steel, silicon manganese, ferrosilicon, titanium, vanadium, niobium and rare earth yttrium in a furnace body, vacuum degassing, and casting into a steel ingot, in which the scrap steel included the following components in percentage by mass: 0.25-0.45% of carbon, 0.05-0.18% of silicon, 0.33-0.65% of manganese, 1.6-4.2% of chromium, 0.6-1.8% of molybdenum, 0.7-1.2% of cobalt, sulfur≤0.02%, phosphorus≤0.02%, and a balance of iron. The smelting mode was as follows. After the material was completely melted, when the molten steel temperature was ≥1600° C., slags were removed, the molten steel was fully stirred and sampled to perform chemical composition analysis, and tapping was performed when the carbon equivalent weight Ceq was controlled to be ≥0.93. The carbon equivalent weight Ceq is calculated according to the following formula: $Ceq=C+Mn/6+(Cr+Mo+V)/5$. White ash was added into the steel ladle in an amount of 0.25-0.3% of the total converter material. The refining mode was as follows. The molten steel was transferred into an LF furnace for refining, and Ar was blew from the bottom of the LF furnace, with a flow rate of Ar being 1.1-1.2 L/min and a pressure of Ar being 0.2-0.3 MPa, and simultaneously silicon carbide and calcium carbide were added into the LF furnace for electrifying and slagging. Alkalinity was adjusted according to slag amount, that is, for a total slag amount of 0.007 kg-0.01 kg/t steel, the alkalinity was controlled to be 2.5-4.0. After the molten steel temperature was ≥1570° C., ferrotitanium was added, and the mass percentage of Ti in ferrotitanium was 28-30%. After the molten steel reached the following components of 0.20-0.40% of carbon, 0.05-0.20% of silicon, 0.30-0.60% of manganese, 1.00-4.00% of chromium, 0.50-1.50% of molybdenum, 0.20-0.60% of vanadium, 0.60-1.00% of cobalt, 0.06-0.16% of titanium, 0.03-0.08% of yttrium, 0.03-0.08% of niobium, 0.005-0.012% of phosphorus, and 0.003-0.008% of sulfur, calcium iron wire was added into the LF furnace, rare earth was added in an amount of 0.05-0.08 g/kg steel, and the $SiO_2$ content in the slag was controlled to be ≤10% after the LF refining was finished. The molten steel was cast to form an ingot.

Diffusion annealing: the steel ingot was kept at a high temperature of 1100° C. for 9 h.

Forging: multidirectional forging was performed on the steel ingot after diffusion annealing to obtain a forging blank.

Post-forging heat treatment: the forging blank was cooled to 600° C. in a mist cooling mode, then air-cooling was performed until the temperature dropped to 200° C. or below, then the air-cooled forging blank was kept at 950° C. for 8 h, and then air-cooling was performed to 200° C. or below to obtain a heat-treated forging blank.

Dehydrogenating and annealing: the heat-treated forging blank was kept at 600° C. for 25 hours, and cooled to 250° C. or below to obtain the dehydrogenated annealed forging blank.

Tempering heat treatment: the dehydrogenated annealed forging blank was kept at 550° C. for 15 hours, the forging blank was cooled to 200° C. or blow, and then air-cooling was performed to room temperature to obtain the hot working die steel.

In the steps of post-forging heat treatment, dehydrogenating and annealing and tempering heat treatment, the heating rate was 8° C./min, and the cooling rate was 15° C./h.

As shown in Table 1, the hot working die steels with high thermal strength and high toughness of Examples 1 to 6 differ mainly in the mass percentage of each component in the steels.

TABLE 1

Components of Die Steels of Examples 1-6

| | Example 1 | Example 2 | Example 3 | Example 4 | Example 5 | Example 6 |
|---|---|---|---|---|---|---|
| Carbon | 0.20 | 0.30 | 0.40 | 0.30 | 0.40 | 0.035 |
| Silicon | 0.05 | 0.12 | 0.20 | 0.05 | 0.10 | 0.08 |
| Manganese | 0.30 | 0.04 | 0.60 | 0.20 | 0.30 | 0.25 |
| Chromium | 1.00 | 2.00 | 4.00 | 2.00 | 3.00 | 2.50 |
| Molybdenum | 0.50 | 1.00 | 1.50 | 0.80 | 1.20 | 1.00 |
| Vanadium | 0.20 | 0.40 | 0.60 | 0.30 | 0.50 | 0.40 |
| Cobalt | 0.60 | 0.80 | 1.00 | 0.70 | 0.90 | 0.80 |
| Titanium | 0.06 | 0.12 | 0.16 | 0.08 | 0.12 | 0.12 |
| Yttrium | 0.03 | 0.05 | 0.08 | 0.04 | 0.06 | 0.06 |
| Niobium | 0.03 | 0.06 | 0.08 | 0.04 | 0.06 | 0.06 |
| Phosphorus | 0.005 | 0.01 | 0.012 | 0.005 | 0.005 | 0.005 |
| Sulfur | 0.003 | 0.004 | 0.008 | 0.003 | 0.003 | 0.003 |
| Iron and inevitable impurities | 97.022 | 95.096 | 91.36 | 95.482 | 93.352 | 94.687 |
| Aggregate | 100 | 100 | 100 | 100 | 100 | 100 |

Examples 7-10

As shown in Table 2, Examples 7 to 9 are mainly different from Example 6 in that the weight ratio of titanium to vanadium in the steel is different, and Example 10 is mainly different from Example 6 in that the weight ratio of yttrium to niobium in the steel is different. The hot working die steels of Examples 7-10 are manufactured by the same process as in Example 1.

TABLE 2

Components of Die Steels of Examples 7-10

| | Example 7 | Example 8 | Example 9 | Example 10 |
|---|---|---|---|---|
| Carbon | 0.035 | 0.035 | 0.035 | 0.035 |
| Silicon | 0.08 | 0.08 | 0.08 | 0.08 |
| Manganese | 0.25 | 0.25 | 0.25 | 0.25 |
| Chromium | 2.50 | 2.50 | 2.50 | 2.50 |
| Molybdenum | 1.00 | 1.00 | 1.00 | 1.00 |
| Vanadium | 0.40 | 0.30 | 0.50 | 0.40 |
| Cobalt | 0.80 | 0.80 | 0.80 | 0.80 |
| Titanium | 0.10 | 0.10 | 0.10 | 0.10 |
| Yttrium | 0.06 | 0.06 | 0.06 | 0.03 |
| Niobium | 0.06 | 0.06 | 0.06 | 0.06 |
| Phosphorus | 0.005 | 0.005 | 0.005 | 0.005 |
| Sulfur | 0.003 | 0.003 | 0.003 | 0.003 |
| Iron and inevitable impurities | 94.707 | 94.807 | 94.607 | 94.737 |
| Aggregate | 100 | 100 | 100 | 100 |

Example 11

Example 11 differed from Example 7 in that the temperature in the diffusion annealing step was 1200° C. and the preservation time was 15 h. The post-forging heat treatment was performed as follows: the forging blank was firstly cooled to 600° C. in a mist cooling mode, then air-cooled to 200° C., then the air-cooled forging blank was kept at 1150° C. for 10 hours, and then air-cooled to 200° C. or below to obtain the heat-treated forging blank. The dehydrogenating and annealing were performed as follow: the heat-treated forging blank was kept at 700° C. for 30 hours, cooled to 200° C. at the rate of 15° C./h during which the temperature was kept for 4 hours each time the temperature was reduced by 100° C., and then it was discharged out of the furnace and cooled to room temperature to obtain the dehydrogenated annealed forging blank. The tempering heat treatment was performed by keeping the dehydrogenated annealed forging blank at 600° C. for 20 h, cooling the forging blank to below 200° C., and then air-cooling to room temperature to obtain the hot working die steel.

Example 12

Example 12 differed from Example 7 in that the temperature in the diffusion annealing step was 1150° C. and the preservation time was 12 h. The post-forging heat treatment was performed as follows: the forging blank was firstly cooled to 600° C. in a mist cooling mode, then air-cooled to 200° C., then the air-cooled forging blank was kept at 1050° C. for 9 h, and then air-cooled to 200° C. or below to obtain the heat-treated forging blank. The dehydrogenating and annealing were performed as follow: the heat-treated forging blank was kepted at 650° C. for 28 hours, and cooled to below 250° C. to obtain the dehydrogenated annealed forging blank. The tempering heat treatment was performed by keeping the dehydrogenated annealed forging blank at 580° C. for 18 h, cooling the forging blank to 200° C., and then air-cooling to room temperature to obtain the hot working die steel.

In the steps of post-forging heat treatment, dehydrogenating and annealing and tempering heat treatment steps, the heating rate was 13° C./min, and the cooling rate was 15° C./h.

Example 13

Example 13 differed from Example 12 in that in the steps of post-forging heat treatment, dehydrogenating and annealing and tempering heat treatment the heating rate was 10° C./min.

Example 14

Example 14 differed from Example 12 in that in the steps of post-forging heat treatment, dehydrogenating and annealing and tempering heat treatment the heating rate was 10° C./min and the cooling rate was 20° C./h.

Example 15

Example 15 differed from Example 12 in that in the steps of post-forging heat treatment, dehydrogenating and annealing and tempering heat treatment the heating rate was 10° C./min and the cooling rate was 17° C./h.

COMPARATIVE EXAMPLE

Comparative Example 1

The hot working die steel of Comparative Example 1 was a commercially available 4Cr5MoSiV1(H13) steel having a chemical composition of 0.35% by mass of carbon, 0.1% by mass of silicon, 0.4% by mass of manganese, 5% by mass of chromium, 1.5% by mass of molybdenum, 1.0% by mass of vanadium, 0.003% by mass of sulfur, and 0.005% by mass of phosphorus, with a balance of iron and inevitable impurities.

Property Test Experiment

Detection Method/Test Method

Tensile strength test: tensile strength tests were performed according to GB/T 2975-1 standard and five sets of data were averaged.

Impact strength test: impact strength tests were performed according to NADCA #207-90 standard and five sets of data ere averaged.

The test results are shown in Table 3.

TABLE 3

Mechanical Property Values for Various Examples and Comparative Example

| | Tensile strength at 500° C. (Mpa) | Yield strength at 500° C. (Mpa) | Impact strength at 500° C. ($J/m^2$) |
|---|---|---|---|
| Example 1 | 1258 | 1163 | 33.2 |
| Example 2 | 1303 | 1194 | 35.7 |
| Example 3 | 1287 | 1175 | 33.6 |
| Example 4 | 1313 | 1201 | 37.8 |
| Example 5 | 1324 | 1223 | 41.9 |
| Example 6 | 1413 | 1320 | 55.2 |
| Example 7 | 1420 | 1331 | 56.1 |
| Example 8 | 1367 | 1289 | 48.9 |
| Example 9 | 1388 | 1296 | 50.2 |
| Example 10 | 1356 | 1281 | 48.2 |
| Example 11 | 1408 | 1314 | 54.9 |
| Example 12 | 1415 | 1322 | 55.4 |
| Example 13 | 1411 | 1319 | 55.1 |
| Example 14 | 1417 | 1323 | 55.7 |
| Example 15 | 1423 | 1334 | 56.4 |
| Comparative Example 1 | 1100 | 900 | 23.7 |

As can be seen in conjunction with all Examples with Comparative Example 1 and Table 3, the tensile strength, yield strength and impact strength of all examples at 500° C. are higher than those of Comparative Example 1, which indicates that the hot working die steel prepared by the present application has higher thermal strength and toughness and better comprehensive properties.

In conjunction with Examples 1-6 and Table 3, it can be seen that Examples 4-6 exhibit overall higher tensile strength, yield strength, and impact strength at 500° C. than Examples 1-3, in which the comprehensive properties of Example 6 are the best, indicating that the comprehensive properties of the steel can be improved by adjusting the contents of the components of the hot working die steel. The optimum composition is 0.35% of carbon, 0.08% of silicon, 0.25% of manganese, 2.50% of chromium, 1.00% of molybdenum, 0.40% of vanadium, 0.80% of cobalt, 0.1% of titanium, 0.05% of yttrium, and 0.05% of niobium, with a balance of iron and inevitable impurities.

In conjunction with Examples 7-9 and Table 3, it can be seen that Example 7 exhibits overall higher tensile strength, yield strength, and impact strength at 500° C. than Examples 8 and 9, exhibiting good thermal strength and toughness, indicating that the thermal strength and toughness of the steel can be improved when the weight ratio of titanium to vanadium is adjusted to 1:4, and the weight ratio of yttrium to niobium is 1:1, so that the steel has better comprehensive properties.

In conjunction with Examples 7 and 11-12 and Table 3, it can be seen that the diffusion annealing temperature and preservation time have certain effects on the overall properties of the hot working die steel during the manufacturing process; the temperature and heat preservation of post-forging heat treatment, dehydrogenating and annealing and tempering heat treatment also have some effects on the overall properties of the material. In conjunction with Examples 12-16, it can be seen that the heating rate and the cooling rate in the steps of post-forging heat treatment, dehydrogenating and annealing and tempering heat treatment have a certain influence on the overall property of the steel, but the steel still has good thermal strength and high toughness.

The specific embodiments are merely illustrative of the present application and are not intended to be limiting of the present application, and modifications of the embodiments may be made by those skilled in the art after reviewing the description which do not involve an inventive step. The protection sought herein is as long as it is within the scope of the claims appended hereto.

What is claimed is:

1. A manufacturing process of a hot working die steel, comprising the following steps:

material smelting: smelting and refining scrap steel, silicon manganese, ferrosilicon, titanium, vanadium, niobium and rare earth yttrium in a furnace body, vacuum degassing, and casting into a steel ingot, wherein the scrap steel comprises the following components in percentage by mass: 0.25-0.45% of carbon, 0.05-0.18% of silicon, 0.33-0.65% of manganese, 1.6-4.2% of chromium, 0.6-1.8% of molybdenum, 0.7-1.2% of cobalt, sulfur≤0.02%, phosphorus≤0.02%, and a balance of iron;

diffusion annealing: keeping the steel ingot at a high temperature of 1100° C.-1200° C. for 9-15 h;

forging: multidirectionally forging the steel ingot after diffusion annealing, to obtain a forging blank;

post-forging heat treatment: cooling the forging blank to 600° C. in a mist cooling mode, air-cooling to 300° C., keeping the air-cooled forging blank at 950° C.-1150° C. for 8-10 h, and air-cooling to room temperature to obtain a heat-treated forging blank;

dehydrogenating and annealing: keeping the heat-treated forging blank at 600° C.-700° C. for 25-30 h, cooling to 150-200° C. at a rate of ≤35° C./h during which the temperature is kept for 3-5 h each time the temperature is reduced by 100° C., discharging from a furnace and cooling to room temperature to obtain a dehydrogenated annealed forging blank; and tempering heat treatment: holding the dehydrogenated annealed forging blank at 550° C.-600° C. for 15-20 h, cooling the forging blank to 200° C. or below, and air-cooling to obtain the hot working die steel.

2. The manufacturing process according to claim 1, wherein a heating rate in the steps of post-forging heat treatment, dehydrogenating and annealing, and tempering heat treatment is 8° C.-13° C./min.

3. The manufacturing process according to claim 1, wherein a cooling rate in the steps of post-forging heat treatment, dehydrogenating and annealing, and tempering heat treatment is 15° C.-20° C./h.

4. The manufacturing process according to claim 1, wherein the hot working die steel comprises the following components in percentage by mass: 0.20-0.40% of carbon, 0.05-0.20% of silicon, 0.30-0.60% of manganese, 1.00-4.00% of chromium, 0.50-1.50% of molybdenum, 0.20-0.60% of vanadium, 0.60-1.00% of cobalt, 0.06-0.16% of titanium, 0.03-0.08% of yttrium, 0.03-0.08% of niobium, 0.005-0.012% of phosphorus, 0.003-0.008% of sulfur, and a balance of iron and inevitable impurities.

5. The manufacturing process according to claim 1, wherein the hot working die steel comprises the following components in percentage by mass: 0.30-0.40% of carbon, 0.05-0.10% of silicon, 0.20-0.30% of manganese, 2.00-3.00% of chromium, 0.80-1.20% of molybdenum, 0.30-0.50% of vanadium, 0.70-0.90% of cobalt, 0.08-0.12% of titanium, 0.04-0.06% of yttrium, 0.04-0.06% of niobium, and a balance of iron and inevitable impurities.

6. The manufacturing process according to claim 5, wherein the hot working die steel comprises the following components in percentage by mass: 0.35% of carbon, 0.08% of silicon, 0.25% of manganese, 2.50% of chromium, 1.00% of molybdenum, 0.40% of vanadium, 0.80% of cobalt, 0.1% of titanium, 0.05% of yttrium, 0.05% of niobium, and a balance of iron and inevitable impurities.

7. The manufacturing process according to claim 4, wherein a weight ratio of titanium to vanadium is 1:4.

8. The manufacturing process according to claim 4, wherein a weight ratio of yttrium to niobium is 1:1.

* * * * *